US010906341B2

(12) United States Patent
Paik et al.

(10) Patent No.: US 10,906,341 B2
(45) Date of Patent: Feb. 2, 2021

(54) THERMOSENSITIVE RECORDING MATERIAL

(71) Applicants: Kyu-Cheol Paik, Dongducheon-si (KR); Jung-Ok An, Anyang-si (KR); HANSOL PAPER CO., LTD., Seoul (KR)

(72) Inventors: Kyu-Cheol Paik, Dongducheon-si (KR); Jung-Ok An, Anyang-si (KR)

(73) Assignees: Kyu-Cheol Pair, Dongducheon-si (KR); Jung-ok An, Anyang-si (KR); HANSOL PAPER CO., LTD., Seoul (KR)

( * ) Notice: Subject to any disclaimer, the term of this patent is extended or adjusted under 35 U.S.C. 154(b) by 180 days.

(21) Appl. No.: 16/060,935

(22) PCT Filed: Dec. 9, 2016

(86) PCT No.: PCT/KR2016/014465

§ 371 (c)(1),
(2) Date: Jun. 9, 2018

(87) PCT Pub. No.: WO2017/099529

PCT Pub. Date: Jun. 15, 2017

(65) Prior Publication Data

US 2018/0361770 A1 Dec. 20, 2018

(30) Foreign Application Priority Data

Dec. 10, 2015 (KR) ..... 10-2015-0175881

(51) Int. Cl.

| | |
|---|---|
| ***B41M 5/333*** | (2006.01) |
| ***B41M 5/337*** | (2006.01) |
| ***B41M 5/323*** | (2006.01) |
| *B41M 5/327* | (2006.01) |

(52) U.S. Cl.

CPC ..... *B41M 5/3333* (2013.01); *B41M 5/323* (2013.01); *B41M 5/3375* (2013.01); *B41M 5/3275* (2013.01); *B41M 2205/04* (2013.01)

(58) Field of Classification Search

CPC ... B41M 5/323; B41M 5/3333; B41M 5/3375
See application file for complete search history.

(56) References Cited

U.S. PATENT DOCUMENTS

| | | | | |
|---|---|---|---|---|
| 5,246,906 | A | 9/1993 | Takahashi | |
| 5,661,100 | A * | 8/1997 | Minami ..... | B41M 5/3333 503/208 |
| 2005/0148467 | A1 | 7/2005 | Makitalo et al. | |

FOREIGN PATENT DOCUMENTS

| | | | |
|---|---|---|---|
| EP | 0 526 072 | B1 | 9/1995 |
| JP | 06-64334 | A | 3/1994 |
| JP | 07-47772 | A | 2/1995 |
| JP | H08-2111 | A | 1/1996 |
| JP | H08-2112 | A | 1/1996 |
| JP | 11-216956 | A | 8/1999 |
| JP | 2001246856 | A | 9/2001 |
| JP | 2001246858 | A | 9/2001 |
| JP | 2003-054137 | A | 2/2003 |
| KR | 10-1993-0000287 | A | 1/1993 |
| KR | 10-1993-0007684 | A | 5/1993 |
| KR | 10-1993-0012363 | A | 7/1993 |

* cited by examiner

*Primary Examiner* — Gerard Higgins
(74) *Attorney, Agent, or Firm* — Maschoff Brennan

(57) ABSTRACT

The present invention relates to a thermosensitive recording material and, specifically, to a thermosensitive recording material comprising: a colorless or light-colored leuco dye; a compound of chemical formula (1) containing a non-phenolic sulfonyl urea group as a developer; at least one of general formulas II-1, II-2, and II-3 as a sensitizer; a binder; and other fillers. The thermosensitive recording material of the present invention improves the background blurring of a color-developed image by using a non-phenolic developer and exhibits excellent effects in view of color development sensitivity, water resistance, oil resistance, plasticizer resistance, and the like.

6 Claims, No Drawings

THERMOSENSITIVE RECORDING MATERIAL

TECHNICAL FIELD

The present invention relates to a recording material produced using a non-phenolic developer having a sulfonyl urea group in a molecular structure thereof.

BACKGROUND ART

Since the 1970s, when a phenolic developer exhibiting black through reaction with a colorless thermosensitive colorant having a lactone ring was developed, a thermosensitive recording sheet using the above phenolic developer has been developed. In order to perform recording on the thermosensitive recording sheet coated with the thermosensitive colorant and the developer, a thermal printer equipped with a thermal head is used. Such thermosensitive recording process involves advantages such as no occurrence of noise during recording, no requirement for development and fixation, easy and convenient maintenance, etc. Further, an instrument used for this process is relatively cheap, has a small size and achieves clear color development. Therefore, thermosensitive recording is broadly used in the fields of facsimiles and computers, various measuring instruments, label blanks, receipt sheets, etc. As the recording instruments become more various and have higher performance, the thermosensitive recording sheet requires higher quality.

In recent years, there is a requirement for thermosensitive recording materials with relatively high color development sensitivity even at a lower energy and excellent image retention ability without background fog (undesired color development of the background caused by heating and the like during preservation). Factors seriously affecting color development sensitivity may include dyes and developers used to form a recording layer of the thermosensitive recording sheet.

As the developer, bisphenol A (4,4'-isopropylidene diphenol) has been most commonly used until now due to low production cost thereof. However, color development sensitivity is insufficient and image retention ability such as plasticizer resistance and heat resistance is also unsatisfactory. Further, there is an increasing tendency toward prohibition of using bisphenol A around the world since bisphenol A is a xenohormone. Actually, some countries have prohibited thermosensitive recording materials using bisphenol A.

In order to solve the above problem, bisphenol S (4,4'-dihydroxydiphenylsulfone) is sometimes used as a developer. However, bisphenol S has drawbacks such as higher melting point and relatively low color development sensitivity. Further, bisphenol S is also a phenolic developer which can hardly overcome a problem of harmful effects on the environment and human health.

JP-A-8-2111 and JP-A-8-2112 disclose thermosensitive recording materials obtained using non-phenolic developers, respectively, wherein a development layer containing a colorless or light colored dye precursor and an urea compound is included. However, such a thermosensitive recording material as described above has a low development concentration and insufficient stability for preservation.

DISCLOSURE

Technical Problem

With a decrease in size of an instrument, a developer for thermosensitive recording materials, which is able to have good color development sensitivity even at a low energy, is required. However, existing developers having high color development sensitivity entail problems of background fog and poor image retention. When intending to improve such background fog and image retention of a developer, the developer entails another problem such as increase in molecular weight and reduction in color development sensitivity at low energy.

Accordingly, the present invention has been developed to solve the problems mentioned above and an object of the present invention is to provide a thermosensitive recording material with excellent color development sensitivity at low energy, and high image retention ability while improving background fogging so as to achieve excellent balance between both of these characteristics.

Technical Solution

The present invention provides a thermosensitive recording material, which includes: a leuco dye; a developer containing a compound represented by Formula (I); and a sensitizer containing at least one selected from groups represented by Formulae (II-1), (II-2) and (II-3).

(I)

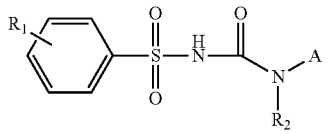

wherein $R_1$ is a hydrogen atom or methyl; $R_2$ is a hydrogen atom, methyl or ethyl; A is a C1-C8 alkyl, cycloalkyl or aromatic group, or an aromatic group substituted by methyl or a halogen atom;

(II-1)

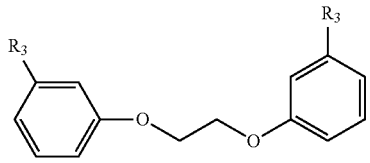

wherein $R_3$ is a hydrogen atom or methyl, (II-2)

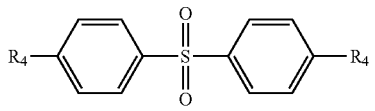

wherein $R_4$ is a hydrogen atom, methoxy or diallyloxy, (II-3)

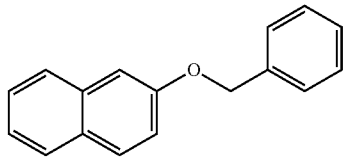

Advantageous Effects

The thermosensitive recording material of the present invention improves blurring of uncolored portions (background, original surface of the recording material), compared to any conventional recording material including bisphenol A as a developer. Further, the thermosensitive recording material of the present invention has advantages including excellent water resistance, oil resistance, plasticizer resistance, etc., as well as excellent color development sensitivity. That is, the thermosensitive recording material of the present invention has advantages including excellent color development sensitivity even at a low energy, no background fog and excellent image retention, thereby achieving good balance between the above characteristics.

Best Mode

The present inventors have found that using specific developers and sensitizers as a thermosensitive recording material may achieve excellent color development sensitivity even at low energy, no background fog and excellent image retention, thereby completing the present invention.

Hereinafter, the present invention will be described in more detail.

<Alkaline Leuco Dye>

The thermosensitive recording material of the present invention may include a colorless or light-colored leuco dye to express a color by reaction.

As a leuco dye, the present invention may use any material known in the field of conventional pressure-sensitive or thermosensitive recording sheets. Preferably, fluoran leuco dyes may be selected from, for example: 3-diethylamino-6-methyl-7-anilinofluoran, 3-dibutylamino-6-methyl-7-anilinofluoran, 3-(N-methyl-N-cyclohexylamino)-6-methyl-7-anilinofluoran, 3-(N-ethyl-N-isopentylamino)-6-methyl-7-anilinofluoran, 3-isobutylethylamino-6-methyl-7-anilinofluoran, 3-[N-ethyl-N-(3-ethoxypropyl)amino]-6-methyl-7-anilinofluoran, 3-(N-ethyl-N-hexylamino)-6-methyl-7-anilinofluoran, 3-dipentylamino-6-methyl-7-anilinofluoran, 3-(N-methyl-N-propylamino)-6-methyl-7-anilinofluoran, 3-(N-ethyl-N-tetrahydrofurylamino)-6-methyl-7-anilinofluoran, 3-diethylamino-6-methyl-7-(p-chloroanilino)fluoran, 3-diethylamino-6-methyl-7-(o-chloroanilino)fluoran, 3-(p-toluidinoethylamino)-6-methyl-7-anilinofluoran, 3-diethylamino-6-methyl-7-(p-toluidino)fluoran, 3-diethylamino-7-(o-chloroanilino)fluoran, 3-dibutylamino-7-(o-chloroanilino)fluoran, 3-diethylamino-7-(o-fluoroanilino)fluoran, 3-dibutylamio-7-(o-fluoroanilino)fluoran, 3-diethylamino-7-(3,4-dichloroanilino)fluoran, 3-pyrrolidino-6-methyl-7-anilinofluoran, 3-diethylamino-6-chloro-7-ethoxyethylaminofluoran, 3-diethylamino-6-chloro-7-anilinofluoran, 3-diethylamino-7-chlorofluoran, 3-diethylamino-6-chloro-7-methylfluoran, 3-diethylamino-7-methylfluoran, 3-diethylamino-7-octylaminofluoran, 3-diethylamino-7-phenylfluoran and 3-(p-toluidinoethylamino)-6-methyl-7-phenetylfluoran. More preferably, at least one selected from 3-diethylamino-6-methyl-7-anilinofluoran, 3-dibutylamino-6-methyl-7-anilinofluoran, 3-(N-ethyl-N-isopentylamino)-6-methyl-7-anilinofluoran, 3-(N-methyl-N-propylamino)-6-methyl-7-anilinofluoran, 3-diethylamino-6-methyl-7-(p-chloroanilino)fluoran and 3-diethylamino-6-methyl-7-(o-chloroanilino)fluoran is used.

<Developer>

The thermosensitive recording material of the present invention may include a compound represented by Formula (I) below as a developer to develop the leuco dye and form text characters or images.

(I)

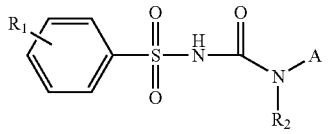

wherein $R_1$ is a hydrogen atom or methyl; $R_2$ is a hydrogen atom, methyl or ethyl; A is a C1-C8 alkyl, cycloalkyl or aromatic group, or an aromatic group substituted by methyl or a halogen atom;

The aromatic group is preferably a phenyl group.

Among the compounds represented by Formula (I) above, compounds represented by the following Formulae are more preferably used.

(I-1)

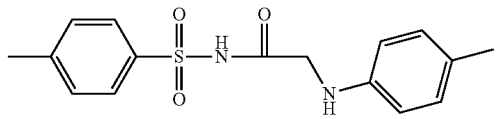

(I-2)

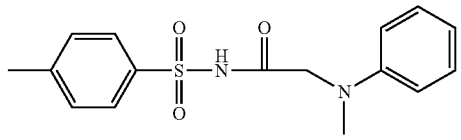

(I-3)

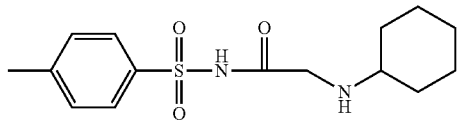

The inventive developer represented by Formula (I) may be used alone and, even when used alone, may have advantages of expressing desired color development sensitivity and stability. The present invention may also use the compound of Formula (I) as a developer in combination with other known developer. In this case, the developer of Formula (I) is preferably included in an amount of 80 to 100% by weight ('wt. %'). The amount of the developer preferably ranges from 0.5 to 3 parts by weight ('wt. part') to 1 wt. part of leuco dye in view of color development sensitivity.

<Sensitizer>

If using a sensitizer containing at least one selected from the following Formulae (II-1), (II-2) and (II-3) as well as the above developer, the thermosensitive recording material of the present invention may have advantages of preventing background fog, and improving water resistance, oil resistance and plasticizer resistance as well as, especially, providing excellent color development sensitivity.

(II-1)

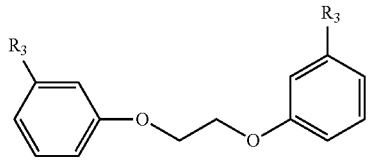

wherein $R_3$ is a hydrogen atom or methyl.

(II-2)

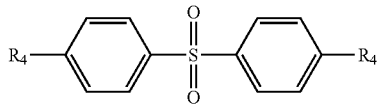

wherein $R_4$ is a hydrogen atom, methoxy or diallyloxy.

(II-3)

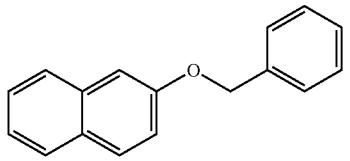

The sensitizer preferably includes at least one selected from 1,2-di-(3-methylphenoxy)ethane, 1,2-di-phenoxyethane, diphenylsulfone, 4,4'-diallyloxydiphenylsulfone and -benzyloxynaphthalene. The sensitizer is preferably included in an amount of 0.5 to 3 wt. parts to 1 wt. part of leuco dye.

The thermosensitive recording material of the present invention may further include a binder, a pigment and other additives in addition to the dye, developer and sensitizer described above.

<Binder>

The thermosensitive recoding material of the present invention may include any binder known in the field of conventional pressure-sensitive or thermosensitive recording sheets. Preferably, fully saponified polyvinyl alcohol, partially saponified polyvinyl alcohol, acetoacetylated polyvinyl alcohol, carboxy modified polyvinyl alcohol, amide modified polyvinyl alcohol, sulfonic acid modified polyvinyl alcohol, butyral modified polyvinyl alcohol, olefin modified polyvinyl alcohol, nitrile modified polyvinyl alcohol, pyrrolidone modified polyvinyl alcohol, silicone modified polyvinyl alcohol, other modified polyvinyl alcohols, hydroxyethyl cellulose, methyl cellulose, ethyl cellulose, carboxymethyl cellulose, polystyrene, styrene copolymers such as styrene-maleic acid anhydride copolymer, styrene-butadiene copolymer, etc., cellulose derivatives such as ethyl cellulose and acetyl cellulose, casein, gum arabic, oxidized starch, etherification starch, dialdehyde starch, esterification starch, polyvinyl chloride, polyvinyl acetate, polyacrylamide, polyacrylic acid ester, polyvinyl butyral, polyamide resin, silicone resin, petroleum resin, terpene resin, ketone resin, coumarone resin, and the like, may be used. An amount of the binder may range from 5 to 25 wt. % to solid contents in a thermosensitive layer formed on a support of the thermosensitive recording material.

<Pigment>

The thermosensitive recording material of the present invention may further include pigment. Preferably, inorganic or organic pigments including, for example, silica (except for colloidal silica), calcium carbonate, kaolin, calcined kaolin, diatomite, talc, titanium oxide, aluminum hydroxide, etc. may be used. In case of using the pigment, an amount of the pigment may range from 0.1 to 20 wt. parts, preferably, 0.5 to 10 wt. parts to 1 wt. part of leuco dye.

<Other Additives>

The thermosensitive recording material of the present invention may optionally include a lubricant, for example, fatty acid metal salts such as zinc stearate, calcium stearate, etc., wax, silicone resins, and the like. In case of using the lubricant, an amount of the lubricant may range from 0.01 to 10 wt. parts to 1 wt. part of alkaline leuco dye.

Other additives, for example, dispersants, defoamers, fluorescent dyes, etc. may be further included. When the present invention uses such additives, an amount of the same may range from 0.01 to 10 wt. parts to 1 wt. part of leuco dye.

The thermosensitive recording material of the present invention may be carried on a support.

<Support>

Shapes, structures, sizes or raw materials of the support used for the thermosensitive recording material of the present invention are not particularly limited but may be desirably selected in view of purposes thereof. The shape of the support may include, for example, a sheet, roll or planar shape. The support may have a monolayer structure or a laminate structure of multiple layers. The size of the support may be desirably selected in view of use of the thermosensitive recording material. The raw material for the support may include, for example, a plastic film, synthetic paper, high quality paper, regenerated pulp, regenerated paper, glossy paper, oil-proof paper, coated paper, art paper, cast-coated paper, uncoated paper, resin laminate paper, release paper, and the like. Otherwise, a combined sheet formed of the above papers may also be used. A thickness of the support is not particularly limited but may be desirably selected. Preferably, the thickness ranges from 30 to 2,000 μm and, more preferably, 50 to 1,000 μm.

<Process of Preparing Thermosensitive Recording Material>

The thermosensitive recording material of the present invention may be prepared by applying a coating solution including an alkaline leuco dye, a compound of Formula (I) as a developer, at least one selected from compounds of Formulae (II-1), (II-2) and (II-3) as a sensitizer to at least one face of a support then drying the same to form a thermosensitive recording layer. A coating means is not particularly limited but may include, for example, an off-machine coating device or on-machine coating device equipped with a variety of coaters such as an air-knife coater, a load blade coater, a bent blade coater, a bevel blade coater, a roll coater, a curtain coater, etc.

The coating solution for forming a thermosensitive recording layer may be formed by grinding the leuco dye, developer and sensitizer into microfine particles having a particle size of several micrometers by means of a grinder, for example, a ball mill, an attrition device, a sand glider, etc. or any suitable emulsifying device, and then, adding a binder to the particles. A solvent used for the coating solution may be water or alcohols.

Solid contents in the coating solution generally range from 20 to 40 wt %. A coating amount of the thermosensitive layer may be desirably selected in view of composition of the layer and/or use of the thermosensitive recording material. Typically, in terms of dry weight, the coating amount may range from 1 to 20 g/m$^2$, preferably, 2 to 12 g/m$^2$. Optionally, a protective layer, an under-layer, a background layer and/or an intermediate layer may be further applied. Further, this thermosensitive recording layer may be subjected to smoothing treatment using a supercalender. For smoothing treatment, any conventional process known in the art may be used.

PREFERRED EMBODIMENT FOR EMBODYING THE INVENTION

Hereinafter, the present invention will be concretely described by means of embodiments. However, the scope of the present invention is duly not limited thereto.

<Synthesis Example 1> Synthesis of Compound I-1

To a 200 ml three-neck flask equipped with a condenser and a dropping funnel, 10.7 g of p-toluidine and 100 ml of toluene were introduced and fully dissolved. Next, 19.7 g of p-toluene sulfonyl isocyanate was placed in the dropping funnel. The p-toluene sulfonyl isocyanate in the dropping funnel was gently dropped into the flask at room temperature while preventing an internal temperature from exceeding 60° C. After completing dropping, the solution was agitated for 1 hour and then the reaction was terminated. The reacted solution was cooled to room temperature, followed by filtering and drying the separated crystals. After drying, 27.2 g of 99.1% purity (HPLC) compound I-1 was obtained. A structure of the product was determined by NMR.

$^1$H-NMR spectrum (300 MHz, DMSO-d$_6$)

10.5 ppm (1H, s), 8.5 ppm (1H, s), 7.80 ppm (2H, d), 7.30 ppm (2H, d), 7.14 ppm (2H, d), 6.95 ppm (2H, d), 2.37 ppm (3H, s), 2.18 ppm (3H, s)

<Synthesis Example 2> Synthesis of Compound I-2

The same procedures as described in Synthesis Example 1 were executed except that 10.6 g of N-methyl aniline was used as a raw material instead of p-toluidine. 25.7 g of 98.6% purity (HPLC) compound I-2 was obtained.

$^1$H-NMR spectrum (300 MHz, DMSO-d$_6$)

10.5 ppm (1H, s), 7.79 ppm (2H, d), 7.34 ppm (2H, d), 7.13 ppm (2H, d), 7.05 ppm (2H, d), 6.8 ppm (1H, t), 2.71 ppm (3H, s), 2.37 ppm (3H, s)

<Synthesis Example 3> Synthesis of Compound I-3

The same procedures as described in Synthesis Example 1 were executed except that 10.0 g of cyclohexylamine was used as a raw material instead of p-toluidine. 26.7 g of 99.2% purity (HPLC) compound I-3 was obtained.

$^1$H-NMR spectrum (300 MHz, DMSO-d$_6$)

10.5 ppm (1H, s), 5.8 ppm (1H, s), 7.80 ppm (2H, d), 7.14 ppm (2H, d), 3.40 ppm (1H, m), 1.53-1.76 ppm (4H, m), 1.40-1.49 ppm (6H, m)

<Example 1> Preparation of Thermosensitive Recording Material

The following A to D solutions were wet-ground by means of a sand grinder until each of the components had an average particle size of 0.5 μm. Herein, the average particle size refers to an average diameter in volume-based distribution, and is determined by a laser diffraction/scattering device for measuring particle size distribution. Herein, "parts" means "parts by weight (wt. parts)".

TABLE 1

| Preparation of A solution | |
|---|---|
| Compound I-1 | 5.0 parts |
| Polyvinyl alcohol (10% aqueous solution) | 18.8 parts |
| Water | 12.2 parts |

TABLE 2

| Preparation of B solution | |
|---|---|
| 3-dibutylamino-6-methyl-7-anilinofluoran | 1.3 parts |
| Polyvinyl alcohol (10% aqueous solution) | 4.6 parts |
| Water | 3.1 parts |

TABLE 3

| Preparation of C solution | |
|---|---|
| Compound II-1-1 ($R_3$ is methyl) | 5.0 parts |
| Polyvinyl alcohol (10% aqueous solution) | 18.8 parts |
| Water | 12.2 parts |

TABLE 4

| Preparation of D solution | |
|---|---|
| Compound I-1 | 4.5 parts |
| Compound I-3 | 0.5 part |
| Polyvinyl alcohol (10% aqueous solution) | 18.8 parts |
| Water | 12.2 parts |

Preparation of Coating Solution for Thermosensitive Recording Layer

Mixing the above solutions in the following mixing ratios resulted in a coating solution for a thermosensitive recording layer.

TABLE 5

| | |
|---|---|
| A solution | 36 parts |
| B solution | 18 parts |
| C solution | 36 parts |
| Silica (Mitsusawa, P537 25% water dispersion) | 60 parts |
| Polyvinyl alcohol (10% aqueous solution) | 25 parts |

The coating solution was applied to a substrate sheet having a standard weight of 50 g/m$^2$ by means of a bar coater No. 10. A coating amount of the solution was 5 g/m$^2$ in dry weight. After drying, supercalendering was conducted to produce a thermosensitive recording material.

Example 2

The same procedures as described in Example 1 were executed except that compound II-1-1 was replaced by compound II-2-1 ($R_4$ is hydrogen).

Example 3

The same procedures as described in Example 1 were executed except that compound II-1-1 was replaced by compound II-3.

Example 4

The same procedures as described in Example 1 were executed except that compound I-1 was replaced by compound I-2.

Example 5

The same procedures as described in Example 4 were executed except that compound II-1-1 was replaced by compound II-2-1 ($R_4$ is hydrogen).

Example 6

The same procedures as described in Example 4 were executed except that compound II-1-1 was replaced by compound II-3.

Example 7

The same procedures as described in Example 1 were executed except that A solution was replaced by D solution.

Example 8

The same procedures as described in Example 7 were executed except that compound II-1-1 was replaced by compound II-2-1 ($R_4$ is hydrogen).

Example 9

The same procedures as described in Example 7 were executed except that compound II-1-1 was replaced by compound II-3.

Comparative Example 1

The same procedures as described in Example 1 were executed except that compound I-1 was replaced by BPA (bisphenol A).

Comparative Example 2

The same procedures as described in Example 1 were executed except that compound I-1 was replaced by N-(p-toluenesulfonyl)-N'-(3-p-toluenesulfonyloxyphenyl)urea.

<Color Development Sensitivity>

Using a thermosensitive printer (TH-PMD) of OHKURA Electric Co., a gradation pattern was dot-printed. Image concentrations and background concentrations at applied energy of 0.26 mJ/dot and 0.35 mJ/dot, respectively, were measured by a Macbeth densitometer (using Invar filter). Measurement results are shown in Table 6.

<Background Fog>

The thermosensitive recording material was dot-printed at applied energy of 0.35 mJ/dot, and then, left at 60° C. for 24 hours. The background concentration was measured by a Macbeth densitometer and results thereof are shown in Table 7.

<Heat Resistance>

The thermosensitive recording material was dot-printed at applied energy of 0.35 mJ/dot, and then, left at 60° C. for 24 hours. The image concentration was measured by a Macbeth densitometer and Table 8 shows the image concentration and the image retention rate calculated by the following equation.

Image retention rate (%)=100×(image concentration after test/image concentration before test)

As image retention rate increases, dot-printability and stability of the thermosensitive recording material are improved.

<Plasticizer Resistance>

The thermosensitive recording material was dot-printed at applied energy of 0.35 mJ/dot, followed by bringing a vinyl chloride wrap into contact with the surface of the material and leaving the same at 23° C. for 2 hours. The image concentration and background concentration were measured by a Macbeth densitometer and Table 8 shows the image retention rate.

<Oil Resistance>

The thermosensitive recording material was dot-printed at applied energy of 0.35 mJ/dot, followed by applying diesel oil to the surface of the material and keeping the same in a hot blower at 60° C. for 3 hours. The image concentration was measured by a Macbeth densitometer and Table 8 shows the image retention rate.

<Moisture Resistance>

The thermosensitive recording material was dot-printed at applied energy of 0.35 mJ/dot, and then, left at 40° C. under 90% humidity for 24 hours. The image concentration was measured by a Macbeth densitometer and Table 8 shows the image retention rate.

<Water Resistance>

The thermosensitive recording material was dot-printed at applied energy of 0.35 mJ/dot, and then immersed in tap water at 20° C. and left for 24 hours. The image concentration was measured by a Macbeth densitometer. Table 8 shows the image retention rate.

TABLE 6

| | Background concentration | Image concentration 0.26 mJ/dot | Image concentration 0.35 mJ/dot |
|---|---|---|---|
| Example 1 | 0.06 | 1.26 | 1.38 |
| Example 2 | 0.06 | 1.24 | 1.39 |
| Example 3 | 0.06 | 1.27 | 1.34 |
| Example 4 | 0.06 | 1.21 | 1.30 |
| Example 5 | 0.06 | 1.24 | 1.34 |
| Example 6 | 0.06 | 1.20 | 1.36 |
| Example 7 | 0.07 | 1.29 | 1.43 |
| Example 8 | 0.06 | 1.30 | 1.40 |
| Example 9 | 0.06 | 1.31 | 1.39 |
| Comparative Example 1 | 0.07 | 1.24 | 1.36 |
| Comparative Example 2 | 0.06 | 1.07 | 1.28 |

* The numerical value of the measured image concentration is proportional to color development sensitivity.

TABLE 7

| | Before test | | After test |
|---|---|---|---|
| | Background concentration | Image concentration | Background concentration |
| Example 1 | 0.06 | 1.38 | 0.12 |
| Example 2 | 0.06 | 1.39 | 0.12 |

TABLE 7-continued

| | Before test | | After test |
|---|---|---|---|
| | Background concentration | Image concentration | Background concentration |
| Example 3 | 0.06 | 1.34 | 0.13 |
| Example 4 | 0.06 | 1.30 | 0.12 |
| Example 5 | 0.06 | 1.34 | 0.11 |
| Example 6 | 0.06 | 1.36 | 0.15 |
| Example 7 | 0.07 | 1.43 | 0.15 |
| Example 8 | 0.06 | 1.40 | 0.14 |
| Example 9 | 0.06 | 1.39 | 0.15 |
| Comparative Example 1 | 0.07 | 1.36 | 0.24 |
| Comparative Example 2 | 0.06 | 1.28 | 0.13 |

* The lower the background concentrations before and after test, the better the background fogging phenomenon.

TABLE 8

| | Before test | | Image retention rate (%) | | | | |
|---|---|---|---|---|---|---|---|
| | Background concentration | Image concentration | Heat resistance | Plasticizer resistance | Oil resistance | Moisture resistance | Water resistance |
| Example 1 | 0.06 | 1.38 | 98 | 90 | 92 | 93 | 76 |
| Example 2 | 0.06 | 1.39 | 96 | 92 | 93 | 91 | 75 |
| Example 3 | 0.06 | 1.34 | 95 | 89 | 93 | 91 | 79 |
| Example 4 | 0.06 | 1.30 | 93 | 89 | 91 | 91 | 81 |
| Example 5 | 0.06 | 1.34 | 90 | 91 | 92 | 92 | 84 |
| Example 6 | 0.06 | 1.36 | 94 | 87 | 90 | 89 | 79 |
| Example 7 | 0.07 | 1.43 | 102 | 90 | 93 | 93 | 82 |
| Example 8 | 0.06 | 1.40 | 98 | 91 | 94 | 92 | 78 |
| Example 9 | 0.06 | 1.39 | 100 | 88 | 92 | 93 | 83 |
| Comparative Example 1 | 0.07 | 1.36 | 85 | 74 | 82 | 81 | 16 |
| Comparative Example 2 | 0.06 | 1.28 | 95 | 87 | 93 | 92 | 78 |

* Image retention rate is proportional to stability of the recorded image.

Referring to Table 6, it could be seen that the color development sensitivity in Example 1 to Example 9, respectively, was much higher than that in a case where N-(p-toluenesulfonyl)-N'-(3-p-toluenesulfonyloxylphenyl)urea is used as in Comparative Example 2. Further, compared to results obtained using bisphenol A in Comparative Example 1, superior or substantially equal results were demonstrated.

From results of a performance test with regard to the background fog in Table 7 and results of the image retention rate with regard to different physical properties in Table 8, it could be seen that the results in Example 1 to Example 9 of the present invention were superior to the results obtained using bisphenol A in Comparative Example 1 in terms of background fog and, especially, plasticizer resistance and water resistance. Further, compared to Comparative Example 2, substantially equal results were achieved.

Consequently, the results in the above tables show that the thermosensitive recoding compositions prepared in Example 1 to Example 9 of the present invention have greatly improved background fog and reduction in stability of recorded image caused by bisphenol A as a conventional developer. Simultaneously, it could be understood that a drawback of N-(p-toluenesulfonyl)-N'-(3-p-toluenesulfonyloxyphenyl), that is, poor color development sensitivity, may also be improved.

INDUSTRIAL APPLICABILITY

The thermosensitive recording material of the present invention may be used in a thermosensitive recording method, which is often adopted in the fields of facsimiles and computers, various measuring instruments, label blanks, receipt sheets, etc.

The invention claimed is:

1. A thermosensitive recording material, comprising:

a leuco dye;

a developer consisting of a compound represented by Formula (I-1) and a compound represented by Formula (I-3); and a sensitizer containing a compound of Formulae (II-2):

(I-1)

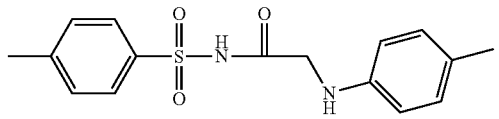

(I-3)

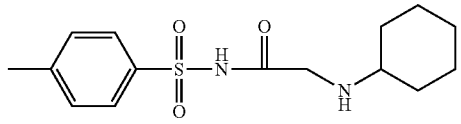

(II-2)

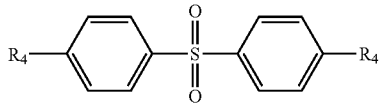

wherein:

$R_4$ is a hydrogen atom, methoxy or allyloxy, the developer is included in an amount of 0.5 to 3 parts by weight ('wt. parts') to 1 wt. part of leuco dye, and the sensitizer is included in an amount of 0.5 to 3 wt. parts to 1 wt. part of leuco dye.

2. The material according to claim 1, wherein, as the sensitizer, at least one selected from diphenylsulfone, 4,4'-diallyloxydiphenylsulfone is included.

3. The material according to claim 1, wherein the leuco dye is at least one selected from 3-diethylamino-6-methyl- 7-anilinofluoran, 3-dibutylamino-6-methyl-7-anilinofluoran, 3-(N-ethyl-N-isopentylamino)-6-methyl-7-anilinofgluoran, 3-(N-methyl-N-propylamino)-6-methyl-7-anilinofluoran, 3-diethylamino-6-methyl-7-(p-chloroanilino)fluoran and 3-diethylamino-6-methyl-7-(o-chloroanilino)fluoran.

4. The material according to claim 1, further including at least one selected from binders, pigments, lubricants and additives.

5. The material according to claim 4, wherein, as the additives, at least one selected from dispersants, defoamers and fluorescent dyes is included in an amount of 0.01 to 10 wt. parts to 1 wt. part of leuco dye.

6. The material according to claim 1, wherein the thermosensitive recoding material is formed to be carried on a support.

* * * * *